US007992321B2

(12) United States Patent
Ricklefs et al.

(10) Patent No.: US 7,992,321 B2
(45) Date of Patent: Aug. 9, 2011

(54) LAUNDRY DRYER HAVING THREE ROLLER DRUM SUPPORT SYSTEM AND REVERSING IDLER ASSEMBLY

(75) Inventors: Michael Paul Ricklefs, Webster City, IA (US); Brian Douglas Ripley, Webster City, IA (US); Robin Alan Hultman, Webster City, IA (US)

(73) Assignee: Electrolux Home Products, Cleveland, OH (US)

( * ) Notice: Subject to any disclaimer, the term of this patent is extended or adjusted under 35 U.S.C. 154(b) by 901 days.

(21) Appl. No.: 11/960,237

(22) Filed: Dec. 19, 2007

(65) Prior Publication Data

US 2009/0158616 A1 Jun. 25, 2009

(51) Int. Cl.
*F26B 11/02* (2006.01)

(52) U.S. Cl. ..... 34/595; 34/601; 34/602; 34/608; 34/610; 68/19.1; 68/20; 366/232; 307/141.8; 8/159; 116/67 R; D34/494

(58) Field of Classification Search ..... 34/595, 34/601, 602, 608, 610; 68/19.1, 20; 366/232; 307/141.8; 8/159; 116/67 R; D34/494
See application file for complete search history.

(56) References Cited

U.S. PATENT DOCUMENTS

| | | | | | |
|---|---|---|---|---|---|
| 2,372,790 | A | * | 4/1945 | Morgenstern | 34/609 |
| 2,385,223 | A | * | 9/1945 | Moore | 34/599 |
| 2,477,820 | A | * | 8/1949 | Pokras | 34/131 |
| 2,503,330 | A | * | 4/1950 | Geldhof | 432/117 |
| 2,506,516 | A | * | 5/1950 | Moore | 384/251 |
| 2,540,725 | A | * | 2/1951 | Geldhof | 34/82 |
| 2,550,118 | A | * | 4/1951 | Kauffman | 34/543 |
| 2,619,734 | A | * | 12/1952 | Geldhof et al. | 34/546 |
| 2,619,736 | A | * | 12/1952 | Geldhof | 34/131 |
| 2,623,299 | A | * | 12/1952 | Kauffman | 34/82 |
| 2,644,245 | A | * | 7/1953 | Hammell et al. | 34/547 |
| 2,670,549 | A | * | 3/1954 | O'Neil | 34/131 |
| 2,679,112 | A | * | 5/1954 | Thompson | 34/562 |
| 2,716,820 | A | * | 9/1955 | Bourner | 34/82 |
| 2,720,037 | A | * | 10/1955 | Erickson | 34/526 |
| 2,743,533 | A | * | 5/1956 | Smith | 34/547 |
| 2,751,688 | A | * | 6/1956 | Douglas | 34/82 |
| 2,752,694 | A | | 7/1956 | McCormick | |
| 2,758,461 | A | * | 8/1956 | Tann | 68/19.1 |
| 2,769,246 | A | * | 11/1956 | Shapter | 34/82 |
| 2,790,247 | A | * | 4/1957 | Olthuis | 34/549 |

(Continued)

FOREIGN PATENT DOCUMENTS

DE 19636705 A1 * 3/1998

(Continued)

*Primary Examiner* — Stephen M. Gravini
(74) *Attorney, Agent, or Firm* — Banner, Witcoff, Ltd.

(57) ABSTRACT

A laundry dryer includes a cylindrical drum shell mounted for rotation on front and rear stationary bulkheads of the dryer. A drive system is configured to rotate the drum in first and second opposite directions. Three rollers are arranged about a lower portion of the drum circumference, on the rear bulkhead, to stably support the rotatable drum during rotation in the first and second directions. The arrangement can also avoid potential flexing and distortion of a cylindrical drum shell of relatively large diameter. In addition, a reversing idler assembly is provided for maintaining proper tension on a drive belt during drum rotation in the two directions. The assembly provides a biased mount for two pulleys on a pair of arms integrally formed with a spring as a single piece, in lieu of separate articulated mounting arms and a separate biasing spring.

21 Claims, 5 Drawing Sheets

U.S. PATENT DOCUMENTS 2,798,302 A * 7/1957 Reiter ..... 34/543
2,798,304 A * 7/1957 Reiter ..... 34/91
2,798,306 A * 7/1957 Reiter ..... 34/609
2,798,307 A * 7/1957 Reiter ..... 34/610
2,822,625 A * 2/1958 Olthuis ..... 34/546
2,835,048 A * 5/1958 Olthuis et al. ..... 34/132
2,842,864 A * 7/1958 Warhus ..... 34/546
2,851,793 A * 9/1958 Thompson ..... 34/601
2,858,619 A * 11/1958 Hughes ..... 34/546
2,873,539 A * 2/1959 Morey ..... 34/597
2,878,580 A * 3/1959 Hughes ..... 34/546
2,882,610 A * 4/1959 Hughes ..... 34/546
2,885,789 A * 5/1959 Conkling et al. ..... 34/547
2,929,674 A 3/1960 Tann
2,941,308 A * 6/1960 Cobb et al. ..... 34/552
2,949,679 A * 8/1960 MacCracken et al. ..... 34/598
2,957,330 A * 10/1960 Cline ..... 68/20
2,961,776 A * 11/1960 Hughes ..... 34/607
2,970,383 A * 2/1961 Hughes ..... 34/527
2,978,232 A * 4/1961 Kruzan ..... 366/232
2,983,050 A * 5/1961 Alaback ..... 34/90
2,996,809 A 8/1961 Shapter
3,008,059 A * 11/1961 Gorsuch et al. ..... 307/141.8
3,029,525 A * 4/1962 Pinder ..... 34/75
3,072,386 A * 1/1963 Horecky ..... 366/232
3,081,554 A * 3/1963 Long ..... 34/543
3,161,481 A * 12/1964 Edwards ..... 34/527
3,197,886 A * 8/1965 Brame et al. ..... 34/90
3,235,082 A * 2/1966 Compans ..... 34/319
3,284,918 A * 11/1966 Malecki et al. ..... 34/547
3,286,363 A * 11/1966 Grimshaw ..... 34/546
3,289,317 A * 12/1966 Lough et al. ..... 34/604
3,330,049 A * 7/1967 Helton ..... 34/139
3,358,302 A * 12/1967 Candor ..... 8/159
3,364,592 A 1/1968 Nighswander et al.
3,402,477 A * 9/1968 Hubbard ..... 34/543
3,403,474 A 10/1968 Spasoff
3,429,056 A * 2/1969 Metzger ..... 34/601
3,471,940 A * 10/1969 Smith ..... 34/603
3,504,444 A * 4/1970 Laue et al. ..... 34/131
3,509,640 A * 5/1970 Davis et al. ..... 34/601
3,514,867 A * 6/1970 Patrick ..... 34/527
3,584,393 A * 6/1971 Menk ..... 34/562
3,713,226 A * 1/1973 Takeyama et al. ..... 34/562
3,722,106 A * 3/1973 Takeyama et al. ..... 34/82
3,890,719 A * 6/1975 Braga et al. ..... 34/572
3,890,720 A * 6/1975 Nichols ..... 34/572
4,022,147 A * 5/1977 Hafstrom ..... 116/67 R
4,069,596 A * 1/1978 Sisler ..... 34/242
4,123,851 A * 11/1978 Itoh et al. ..... 34/549
4,300,293 A * 11/1981 Gladysz ..... 34/108
4,407,077 A * 10/1983 Smith ..... 34/108
4,407,078 A * 10/1983 Takeyama et al. ..... 34/601
4,488,363 A * 12/1984 Jackson et al. ..... 34/572
4,564,098 A 1/1986 Hormann
5,127,169 A 7/1992 Ellingson
5,398,528 A 3/1995 Johnston et al.
5,419,742 A 5/1995 Shimaya
5,501,021 A * 3/1996 Torborg et al. ..... 34/594
5,527,448 A 6/1996 Morel et al.
5,555,645 A 9/1996 Joslin
5,636,453 A * 6/1997 Stacik et al. ..... 34/601
5,651,194 A 7/1997 Hayashi
5,673,497 A * 10/1997 St. Louis ..... 34/486
5,852,881 A * 12/1998 Kuroda et al. ..... 34/527
6,743,131 B1 6/2004 Walker
6,874,250 B2 * 4/2005 Prajescu et al. ..... 34/606
6,941,679 B1 * 9/2005 Harris et al. ..... 34/596
6,968,632 B2 11/2005 Guinibert et al.
7,065,905 B2 * 6/2006 Guinibert et al. ..... 34/603
7,117,613 B2 * 10/2006 Guinibert et al. ..... 34/534
7,207,124 B2 * 4/2007 Kim ..... 34/601
7,225,562 B2 6/2007 Guinibert et al.
7,257,905 B2 * 8/2007 Guinibert et al. ..... 34/82
7,412,783 B2 * 8/2008 Guinibert et al. ..... 34/572
7,467,483 B2 * 12/2008 Guinibert et al. ..... 34/601
7,609,491 B2 * 10/2009 Johnson et al. ..... 361/23
7,762,007 B2 * 7/2010 Guinibert et al. ..... 34/601
2005/0016015 A1 * 1/2005 Prajescu et al. ..... 34/601
2005/0076535 A1 * 4/2005 Guinibert et al. ..... 34/601
2005/0115104 A1 * 6/2005 Guinibert et al. ..... 34/601
2006/0130358 A1 * 6/2006 Kim ..... 34/494
2006/0150439 A1 7/2006 Latack et al.
2006/0254084 A1 11/2006 Ford
2007/0006477 A1 * 1/2007 Guinibert et al. ..... 34/85
2007/0186440 A1 * 8/2007 Guinibert et al. ..... 34/603
2007/0220776 A1 * 9/2007 Guinibert et al. ..... 34/603
2008/0022551 A1 * 1/2008 Banta et al. ..... 34/602
2009/0158616 A1 * 6/2009 Ricklefs et al. ..... 34/601
2010/0024243 A1 * 2/2010 Ricklefs et al. ..... 34/474
2010/0031529 A1 * 2/2010 Johnson et al. ..... 34/525
2010/0132219 A1 * 6/2010 Etemad et al. ..... 34/499

FOREIGN PATENT DOCUMENTS

DE 19728068 A1 * 1/1999
DE 102008044285 A1 * 6/2010
EP 110318 A1 * 6/1984
EP 285072 A2 * 10/1988
EP 709515 A1 * 5/1996
EP 1564324 A1 * 8/2005
EP 1860229 A1 * 11/2007
GB 2073389 A * 10/1981
GB 2078357 A * 1/1982
JP 54133670 A * 10/1979
JP 02142599 A * 5/1990
JP 05115683 A * 5/1993
JP 05115686 A * 5/1993
JP 06339596 A * 12/1994
JP 07194892 A * 8/1995
JP 07229867 A * 8/1995
JP 07265595 A * 10/1995
JP 07308495 A * 11/1995
JP 08252395 A * 10/1996
JP 09075596 A * 3/1997
JP 09094389 A * 4/1997
JP 2001170398 A * 6/2001

* cited by examiner

LAUNDRY DRYER HAVING THREE ROLLER DRUM SUPPORT SYSTEM AND REVERSING IDLER ASSEMBLY

FIELD OF THE INVENTION

The present invention relates to laundry dryers. In particular, the invention concerns a three roller support system for a reversing dryer drum, and a reversing idler assembly.

BACKGROUND OF THE INVENTION

Conventional laundry dryers generally include a rotatable drum in which clothes are tumbled during the drying process. In some dryers, the rotatable drum rotates in a single direction. Other dryers include the capability to sequentially rotate the drum in opposite directions. See, e.g., U.S. Pat. Nos. 5,555,645 and 5,651,194. The conventional systems described in these applications generally employ a drum with a rear end cap that rotates with the drum and is provided with a center axle mount support system for the drum. However, such an arrangement may not provide adequate support for large capacity drums. Additionally, such an arrangement generally occupies more space within the cabinet and requires more material than a drum formed by a cylindrical shell capped and rotatably supported at its ends by stationary front and rear bulkhead structures of the dryer.

Laundry volume capacity is an important attribute of a laundry dryer. The provision of a larger diameter drum will generally increase the volume capacity of the dryer. However, as drum size increases, rotational stability and drum flex/deformation become more of an issue. Hence, the design of the rotational drum support becomes more critical. Many dryer systems include two or more rollers configured to support the rotatable drum. Arrangements such as those described in U.S. Pat. No. 2,752,694 to McCormick include three equally spaced rollers configured to support the dryer drum, used in conjunction with a central axle mount of the drum. However, these arrangements do not account for the drum flex and deformation that may occur with a wide roller spacing in the case of a relatively large diameter bulkhead mounted drum.

Conventional dryers often use a belt drive system to rotate the dryer drum. In such arrangements, the belt is tensioned about the drum and a motor is used to drive the belt in order to rotate the drum. Tensioning pulleys may be used to lessen any slack in the belt in order to efficiently rotate the drum. However, conventional tensioning systems include multiple pieces including multi-piece mounting brackets for pulleys, and separate springs, which add assembly steps and cost to the laundry dryer.

SUMMARY OF THE INVENTION

Dryer drum support assemblies in accordance with aspects of the present invention can provide increased stability and support during bi-directional rotation of a drum, thus facilitating effective implementation of a larger diameter drum with increased volume capacity, particularly one of the bulkhead-mounted variety.

In accordance with an aspect of the invention, a laundry dryer a support system for rotatably supporting the dryer drum. The support system includes a first roller that provides a first rotatable support for the dryer drum, a second roller positioned to one side of the first roller and that provides a second rotatable support for the dryer drum at a circumferentially spaced position on the drum, and a third roller positioned on an opposite side of the first roller and that provides a third rotatable support for the dryer drum at a second circumferentially spaced position on the drum. The second and third dryer drum rollers contact an outer surface of the drum within the lower half of the drum circumference and together stably rotatably support the dryer drum for rotation in the first and second directions.

In a further aspect, a laundry dryer comprises a rotatable drum contained within a housing, wherein the rotatable drum is rotatable in a first direction and a second direction. The laundry dryer further includes a rotatable drum drive system including a drive belt surrounding a portion of the rotatable drum and a motor operatively connected to a drive pulley. The laundry dryer further includes a reversing idler assembly pivotally mounted to a pivot point adjacent the drive pulley. The reversing idler assembly includes a pair of pulleys between which the drive belt extends to loop around the drive pulley. The reversing idler assembly further includes a spring member including two integrally formed arm portions. The two arm portions are configured to receive each of the pair of pulleys for rotatably mounting the pulleys and for biasing the pulleys toward each other to thereby maintain tension on the drive belt as the drum rotates in the first and second directions.

The above and other objects, features and advantages of the present invention will be readily apparent and fully understood from the following detailed description of preferred embodiments, taken in connection with the appended drawings.

DETAILED DESCRIPTION OF EXEMPLARY EMBODIMENTS

Figure 1:
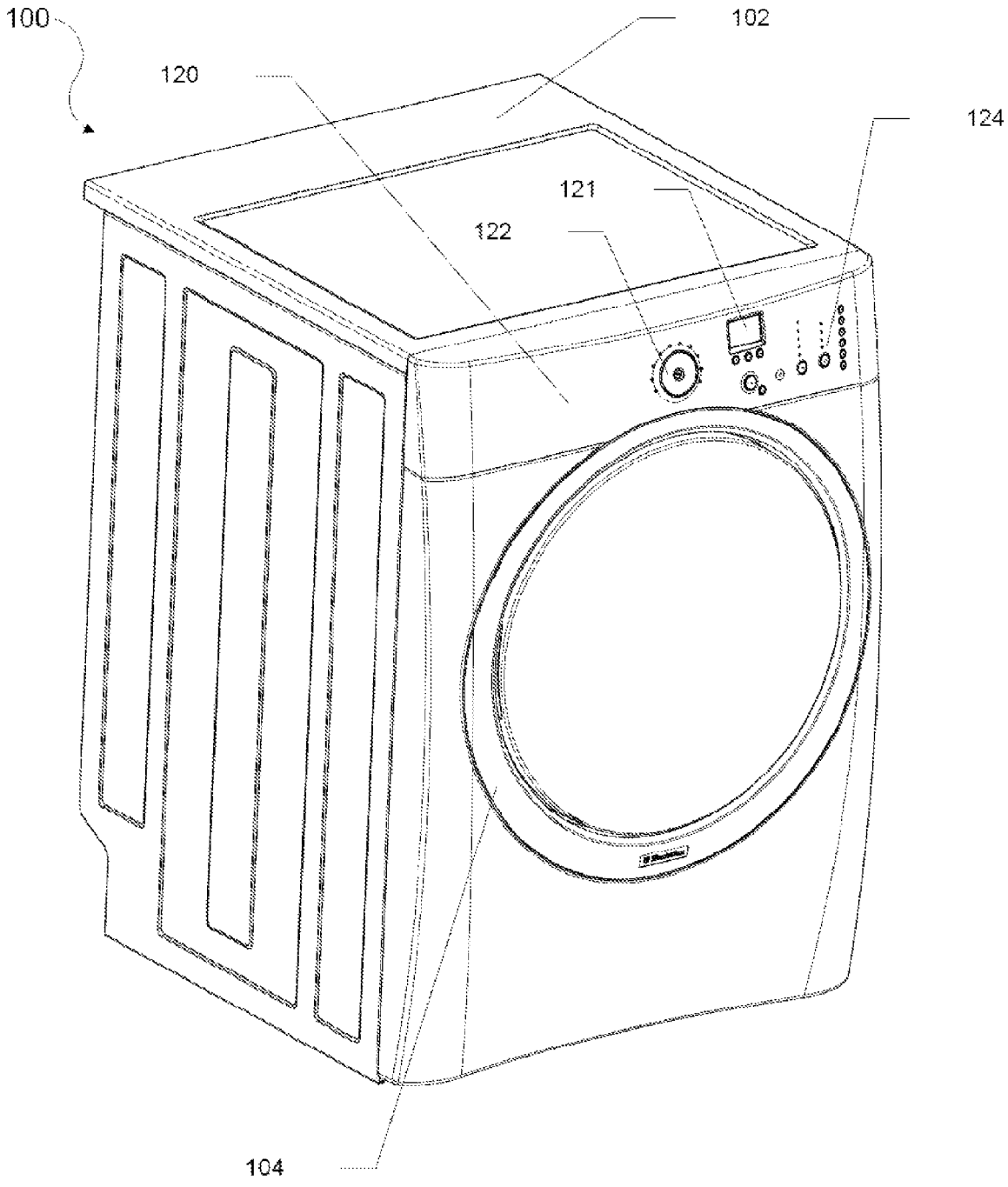
FIG. 1 is a front perspective view of one embodiment of a dryer that may incorporate features in accordance with of the present invention.
Figure 2:
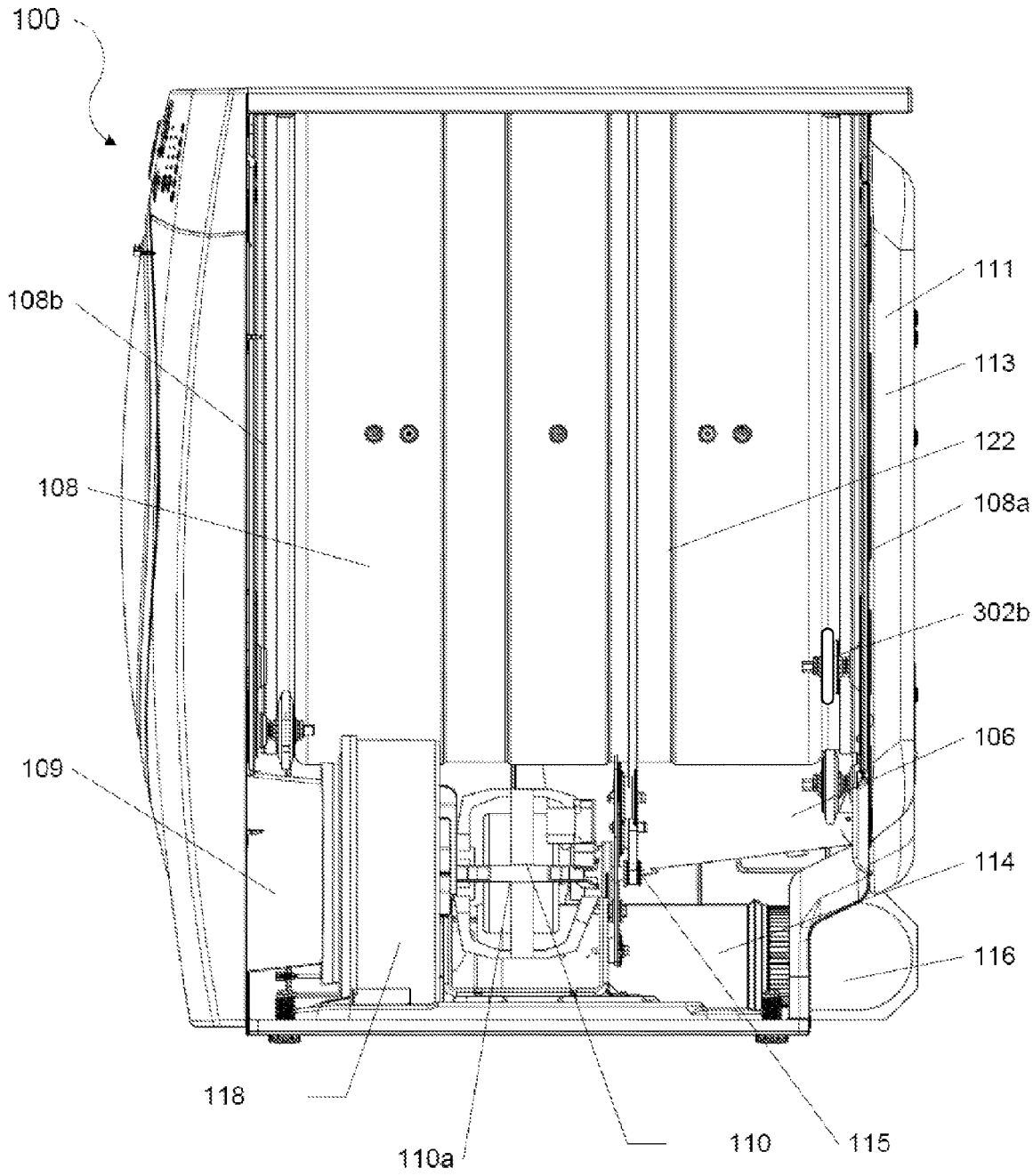
FIG. 2 is a right side elevation view of the illustrative dryer of FIG. 1 with the side panel removed to show internal components.

The three-roller drum support system and reversing idler assembly described herein may be used with any laundry dryer, such as a gas powered laundry dryer, electric powered laundry dryer, stackable laundry dryer, free standing front loading laundry dryer, and the like. FIGS. 1 and 2 illustrate an exemplary embodiment of a laundry dryer 100 in accordance with the present invention. As shown, the dryer 100 includes a housing 102. Housing 102 generally includes a door 104 covering an access port. The dryer may also include a pedestal (not shown in FIG. 1) that is provided to lift the dryer to a raised position for easier access to the dryer access port. The pedestal may include a drawer or cabinet that may be used for storage of laundry related items, such as detergent, fabric softener, and the like.

With further reference to FIG. 1, dryer 100 includes a control panel 120. Control panel 120 generally includes one or more buttons, knobs, indicators, and the like, that are used to control the dryer operation. In the arrangement shown, a knob 122 and one or more buttons 124 are used in conjunction with a user interface display 121 for establishing the dryer settings. The dryer 100 includes electronic control systems necessary for dryer cycle selection and control. Such systems may include a processor, memory, relays and the like, as is generally known in the art.

Housing 102 generally contains electrical and mechanical systems for typical dryer function. For example, referring to FIGS. 2 and 3, a canister-type heater 106 for heating air as it passes through a dryer system is positioned below a rotatable drum 108 in which clothes are contained and tumbled during a dryer cycle. The air is drawn through the heater canister from within the cabinet and heated air is introduced to the rotatable drum 108 through an inlet duct 111 extending along a back side of, and passing through, a rear bulkhead 113 at a rear side of the drum. The air exits the drum 108 from a front side of the drum through a duct 109 including a lint trap (not shown in FIG. 2). The dryer further includes a drive system 110 configured to rotate the rotatable drum 108. The drive system 110 includes a motor 110*a* that rotates the drum 108 via a belt 122 and a drive pulley 115. In the arrangement shown, the motor is also used to drive the blower 118 which creates a vacuum to pull air through the dryer system. On its downstream side, blower 118 is connected with an exhaust tube 114 that connects with an external vent tube 116 for exhausting air from the dryer.

Figure 3:
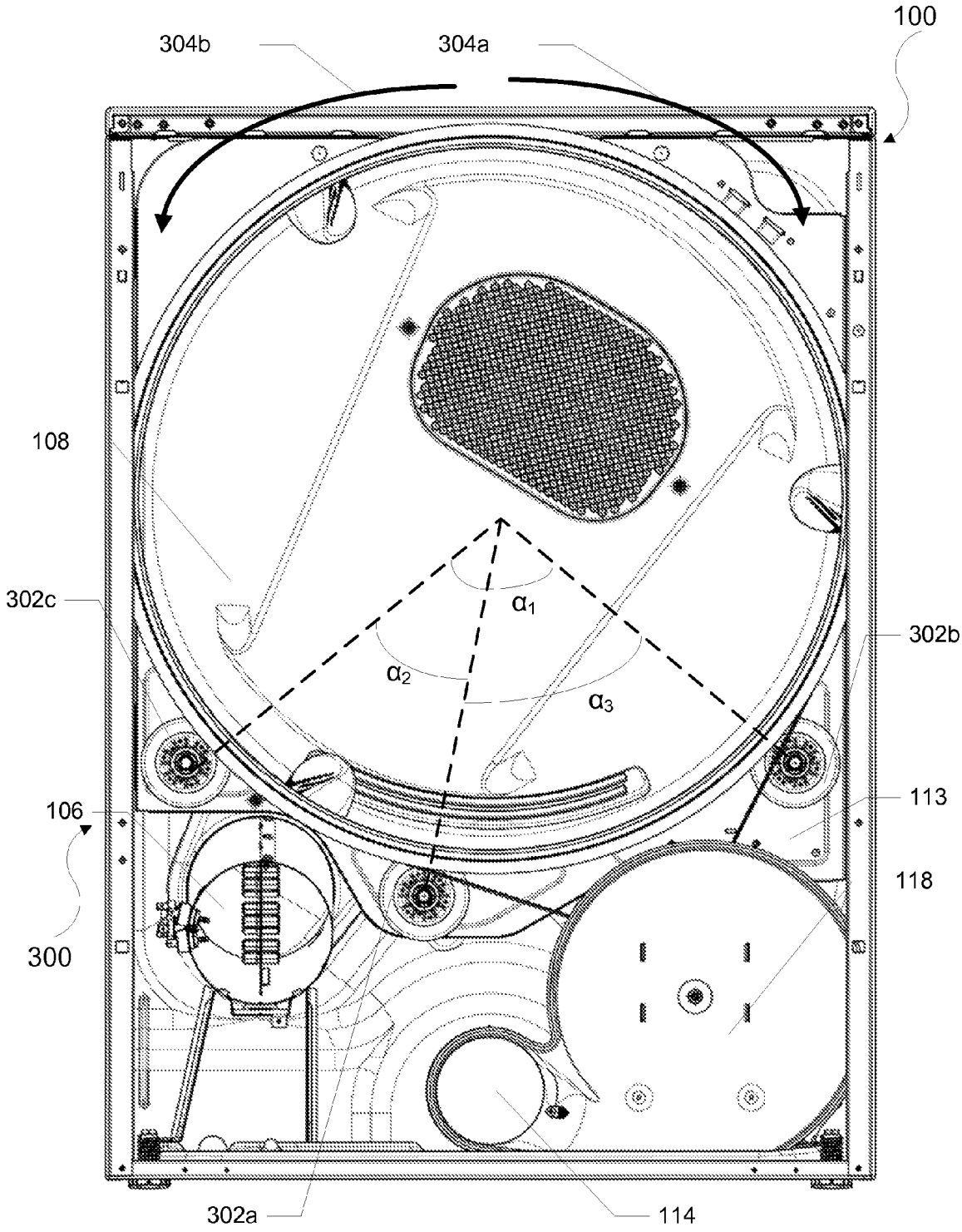
FIG. 3 is a front elevation view of the illustrative dryer with the front panel removed to show internal components, including one arrangement of the inventive three-roller drum support described herein.

With reference to FIG. 3, shown is an illustrative embodiment of a three-roller rotatable drum support system in accordance with an aspect of the invention. The system includes a pair of primary support rollers 302*a*, 302*b*, and a third support roller 302*c*, rotatably mounted at spaced positions on a lower side of rear dryer bulkhead 113. The support system may also include one or more front bulkhead mounted rollers, such as roller 301 (one of a pair) shown in FIG. 2. As mentioned, the rotatable drum may be rotated using a belt drive system. As seen in FIG. 2, belt 122 wraps about the circumference of drum 108 and is driven by motor 110*a* to cause the rotatable drum to rotate about a central axis. Existing dryers employing a bulkhead mount of the rotatable drum, in lieu of a center axle mount, typically only provide for drum rotation in a single direction. These conventional arrangements generally include only two rollers on each of the front and rear bulkheads to provide rotatable support for the drum.

A three roller support system 300 in accordance with an aspect of the invention uses two rear bulkhead-mounted rollers 302*a*, 302*b* similar to those used in existing systems. Such rollers may be offset to one side of a vertical centerline of the drum in order to provide a stable seat for the drum generally centered about an offset location of the drive motor 110 and belt drive pulley 115, e.g., as seen in FIG. 3. An offset position of the drive motor 110 can provide a more efficient use of the limited space within a standard size cabinet or housing, thus permitting a relatively larger drum and/or drive motor to be accommodated. As the drum rotates (e.g. in clockwise direction 304*a* as shown in FIG. 3), belt tension forces pull downwardly on the drum toward the drive pulley 115, thus tending to keep the drum stably rotatably supported within its seat primarily established by rollers 302*a* and 302*b*. The inventors recognized that additional dynamics would have to be accounted for in order to maintain stable drum support during rotation in each of the two opposite directions.

During a dryer operation cycle, rotatable drum 108 may reverse direction. For example, in such an instance, drum 108 may cease rotating in the clockwise direction of arrow 304*a* and begin rotating in the opposite direction as indicated by arrow 304*b*. This bi-directional rotation can aid in tumbling of a dryer load in order to provide more efficient and faster drying of the load within the drum 108. In addition, in the case of a single motor used to both drive the drum rotation and the blower, the differential flow characteristics achieved by driving the blower in different directions, can be used with advantage and convenience in conjunction with a reversal of the drum rotation direction. For example, a finish-dry or cool-down interval could be implemented utilizing a reverse drum rotation and accompanying reduced (or increased) air flow caused by a reversal of the blower wheel.

Substantially different forces are encountered depending upon the drum rotation direction. In particular, the forces acting on the drum by the laundry load as it tumbles within the dryer change substantially. For example, with reference to FIG. 3, for a clockwise rotation 304*a* of the drum 108, a tumbling laundry load will fall from the upper right quadrant of the drum to a region of the bottom of the drum generally between rollers 302*a*, 302*b*, thus providing additional dynamic forces tending to keep the drum stably in its seat established by rollers 302*a*, 302*b*. On the other hand, for rotation in the counter-clockwise direction 304*b*, the tumbling laundry load would generally fall from the upper left quadrant of the drum down to a lower left surface portion of the drum extending at least in part to the outside of roller set 302*a*, 302*b* (to the left of roller 302*a*). The inventors discovered that especially with a large heavy load (made much heavier by retained water), and with an increased "expanded" capacity drum, the tumbling impact and out-of-balance forces generated during a reverse (e.g., counter-clockwise) rotation 304*b* of the drum 108 would be so great as to overcome the forces tending to seat the drum on rollers 302*a*, 302*b* and thereby cause positional drum instability, e.g., rocking of the drum in and out of the seat established by the roller pair 302*a*, 302*b*. Typically, approximately 10 lbs of tension force acts along each length of the belt extending from the drive pulley. These forces may be overcome by the weight and impact of tumbling laundry impacting the drum surface in the lower left quadrant.

To address this situation, the three roller system 300 includes a third roller 302*c* that may also be mounted to the rear bulkhead 113. The third roller 302*c*, which is positioned generally opposite (and at approximately the same height as) roller 302*b* on the other (left) side of central roller 302*a*, provides additional support for rotatable drum 108, and in particular lends stability to the rotational mount of the drum which is reliably maintained regardless of the direction of rotation of the drum. As shown in FIG. 3, in one arrangement, the rollers 302*a*, 302*b*, 302*c* are arranged with angular separations $\alpha_1$, $\alpha_2$, and $\alpha_3$. In one arrangement, $\alpha_1$ may be between 85° and 110°, $\alpha_2$ may be between 30° and 50° and $\alpha_3$ may be between 45° and 90°. In one particular arrangement, $\alpha_1$ may be 98°, $\alpha_2$ may be 40° and $\alpha_3$ may be 58°. Referring to the particular embodiment illustrated, rollers 302*a* and 302*b* provide a seat for stably rotatably supporting drum 108 during clock-wise rotation 304*a* thereof. During counter-clockwise rotation 304*b*, roller 302*c* effectively counters the forces caused by laundry items tumbling onto the interior surface of the drum in the lower left quadrant, to thereby avoid an unseating or rocking of the drum that might otherwise occur. In addition, roller 302*c* provides stability during initial rotation of the drum upon reversal of direction of rotation when the drum contains a load.

The three roller arrangement of the invention provides significant advantages over arrangements of rollers equispaced about a center axle mounted drum. Space efficiency is achieved by keeping all three rollers positioned about the lower half of the drum. In the illustrated embodiment, the three rollers are mounted in spaced relation about the lower-most 60° degree arc of the circumference of the drum. In addition, the inventive three-roller arrangement provides a substantial benefit in comparison to an arrangement of two or three rollers where the angular interval between the rollers is significantly greater. Especially in the case of a relatively large dryer drum, a wide spacing of rollers, such as would result by a simple replacement of roller 302*a* with roller 302*c*, can result in flexing and warpage (e.g., sag) of the circular drum, leading to irregular and inefficient drum rotation, along with attendant excessive vibration and noise. The three-roller arrangement also aids in lessening or preventing fatigue failure associated with the constant flexing of the drum between rollers.

Figure 4:
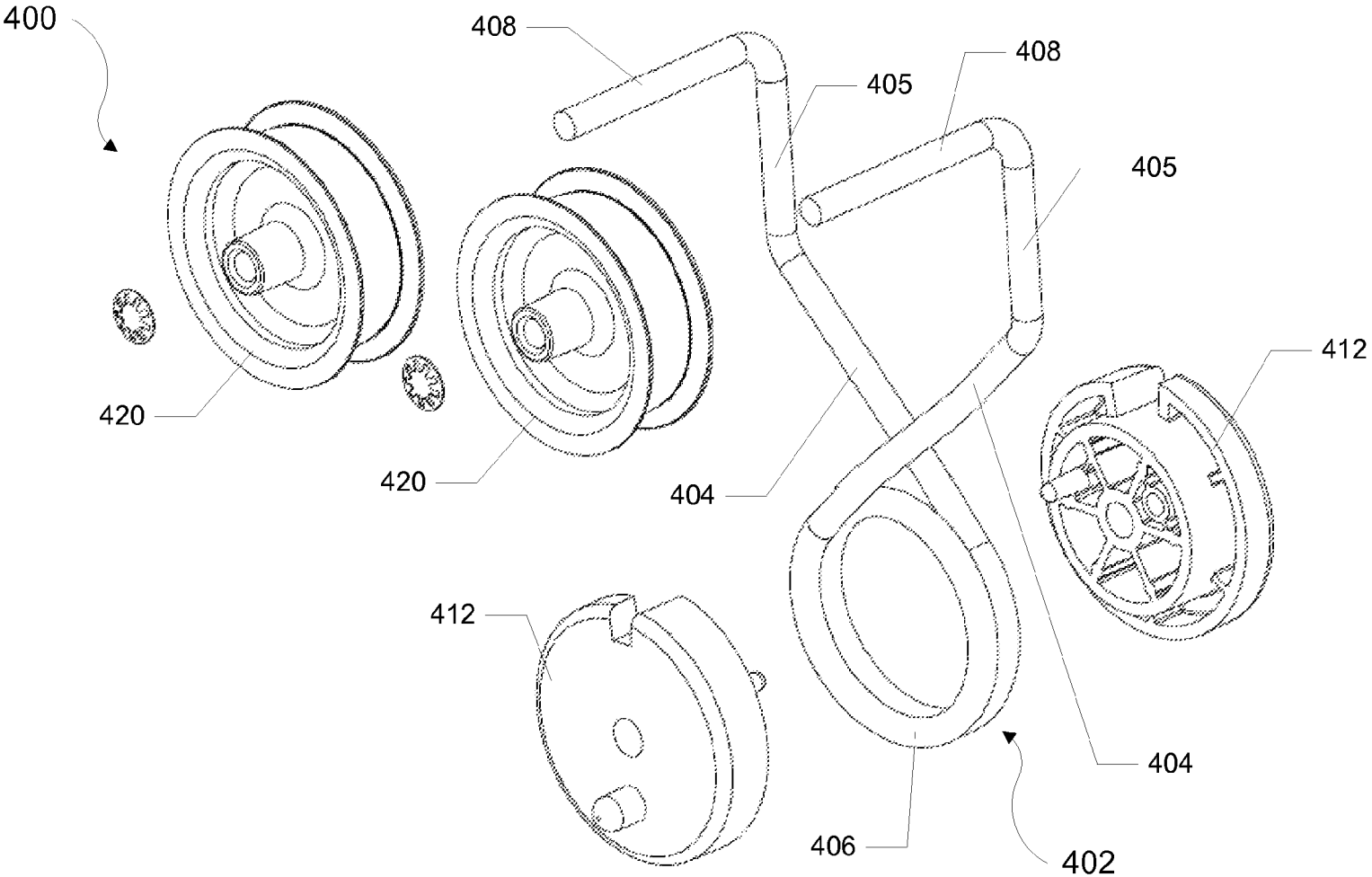
FIG. 4 is an exploded perspective view of a reversing idler assembly in accordance with an aspect of the invention.
Figure 5:
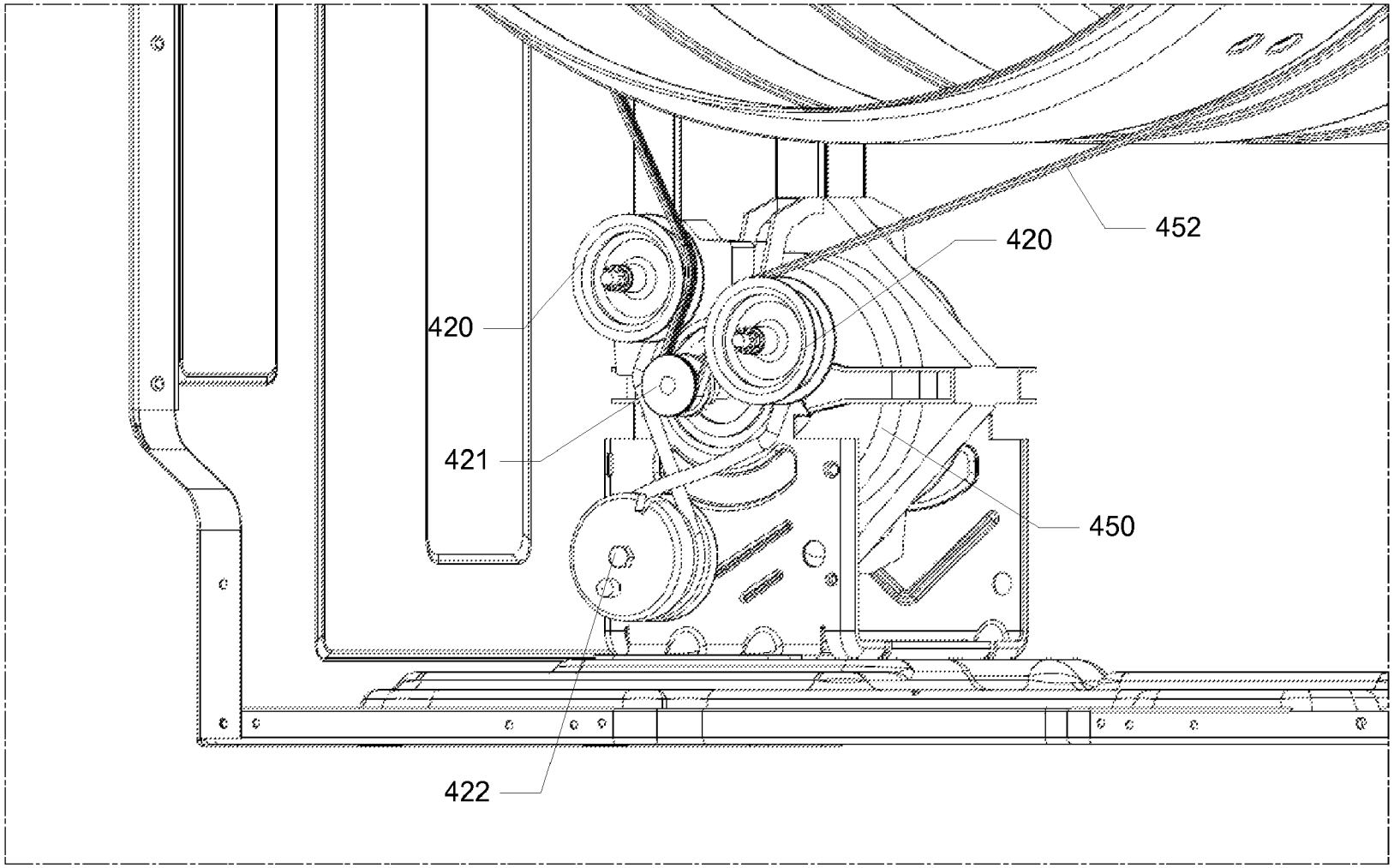
FIG. 5 illustrates the reversing idler assembly of FIG. 4 as it may be mounted in a dryer for use.

With reference now to FIGS. 4 and 5, a reversing idler spring assembly 400 is shown. In general, idler assemblies for maintaining appropriate tension on the drive belt extending about the dryer drum and the drive pulley are known. In accordance with a further aspect of the invention, reversing idler assembly 400 includes two tensioning pulleys biased by a common spring member also serving as a mounting bracket for the pulleys. In a generally known fashion, reversing idler assembly 400 aids in equalizing the drive belt forces regardless of the direction of rotation of the dryer drum. Reversing idler assembly 400 may be used to facilitate drum rotation reversal in conjunction with the three roller drum support system described above, or independently thereof.

Conventionally, an idler assembly has been constructed by pivotably connecting two separate arm members to each other at one end, mounting a pulley on the opposite ends of the respective arms, and biasing those arms toward each other to a predetermined spacing by a separate tension spring attached between the two arms. In contrast, reversing idler assembly 400 provides a mounting bracket with arms for mounting each pulley, and a spring for biasing those arms toward each other (e.g., to a predetermined spacing), as a single integrally formed part. Thus, advantages of part-count reduction and reduced assembly costs may be achieved.

Referring now to FIG. 4, reversing idler assembly 400 is shown in an exploded view. The assembly 400 generally includes a single piece torsional spring member 402 that provides tensioning for a laundry dryer drive belt. The single piece torsional spring member 402 includes two arm portions 404 extending from the outer edge of a spring coil portion 406. Each arm portion 404 includes a bent end 408. In the arrangement shown, the bend is formed at approximately a right angle with respect to the general plane of the coiled portion 406. The bent end portions 408 provide a mount for the idling/tensioner pulleys 420, while coil portion 406 biases arms 404 inwardly toward each other to a predetermined spacing in the illustrated embodiment. The single piece idler spring member 402 may be formed of various suitable material providing the necessary strength, rigidity and spring action, such as spring steel, stainless steel, carbon steel, and the like. In addition, the material may be chrome plated or may include other surface treatments.

Coil 406 may be mounted about a spool-like circular bushing 412 that may be used to mount the assembly to a pivot point (422 in FIG. 5) spaced below the belt drive pulley (421 in FIG. 5) attached to the motor shaft. Extending angularly upward from the coiled portion 406 on a respective side thereof, and crossing to the opposite side, are the two idler spring arms 404.

The idler spring arms 404 further include a substantially vertical portion 405 leading to the perpendicular bent end portions 408. As mentioned, the end portions 408 provide rotatable mounts for the idler pulleys 420 that will guide the drive belt (452 in FIG. 5). In such an arrangement, the tensioning pulleys 420 are biased by a common spring, coiled portion 406. As indicated, such an arrangement can reduce manufacturing costs and may provide ease of assembly, as compared to conventional systems having pulleys mounted to a bracket comprising separately formed and attached arms, and a separate biasing spring.

With further reference to FIG. 5, the reversing idler assembly 400 is shown mounted on a bracket extending up from a floor of the dryer housing, and a dryer drive belt 452 is installed thereon. As shown, the assembly 400 is mounted (at pivot point 422) below motor 450, and the drive shaft 423 and pulley 421 thereof which drives the belt 452. The arms cross each other below the drive shaft and then extend upwardly on either side of the drive shaft so as to position the pulleys 420 just above, and in alignment with, the drive pulley, so as to form therewith a generally triangular arrangement. The belt 452 extends in a loop about the dryer drum. The loop is passed between the two pulleys 420 and about the drive pulley. Reversing idler assembly 400 maintains appropriate tension on the belt 452 so that it may be driven by the drive pulley in order to rotate the rotatable drum without slippage, regardless of the rotation direction. As the rotation of the drum reverses, the idler assembly 400 may pivot about spring pivot center 422 thereby causing the tension to be distributed to an opposite side of the belt to again allow the belt 452 to be driven by the drive pulley in order to rotate the drum without slippage.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A laundry dryer comprising:

a dryer drum rotatable in a first direction and a second direction;

a drive system for selectively rotatably driving the dryer drum in said first and second directions; and a support system for rotatably supporting the dryer drum, comprising:

a first roller that provides a first rotatable support for the dryer drum;

a second roller positioned to one side of the first roller and that provides a second rotatable support for the dryer drum at a circumferentially spaced position on the drum; and a third roller positioned on an opposite side of the first roller and that provides a third rotatable support for the dryer drum at a second circumferentially spaced position on the drum;

wherein each of the first, second and third rollers contacts an outer surface of the drum within the lower half of the drum circumference and together said rollers stably support the drum for rotation in the first and second directions.

2. The laundry dryer of claim 1, wherein the first, second and third rollers are mounted to a stationary structure of the dryer at least partially capping an end of the dryer drum.

3. The laundry dryer of claim 2, said stationary structure comprising a rear drum support of the dryer.

4. The laundry dryer of claim 1, wherein the first, second and third rollers are positioned to contact an outer surface of the drum within the lower most 110° arc of the drum circumference below the dryer drum.

5. The laundry dryer of claim 3, wherein the first roller is arranged in an off-center position between and below the second and third rollers.

6. The laundry dryer of claim 1, wherein the second and third rollers are positioned about the drum circumference at approximately equal heights.

7. The laundry dryer of claim 1, wherein said second and third rollers have an angular separation less than 180°.

8. The laundry dryer of claim 7, wherein said angular separation is in the range of 45°-90°.

9. The laundry dryer of claim 7, wherein the angular separation between the first roller and the second roller, and between the first roller and the third roller, does not exceed 45°.

10. The laundry dryer of claim 1, wherein the drum is mounted to a dryer bulkhead.

11. The laundry dryer of claim 1, wherein the drive system comprises a motor, a drive pulley and a belt that extends about the drum and said drive pulley.

12. The laundry dryer of claim 11, wherein the laundry dryer further includes a blower that is driven by the motor of the drive system.

13. The laundry dryer of claim 11, wherein the motor and drive pulley are positioned below and offset with respect to a vertical center line of the drum.

14. The laundry dryer of claim 11, further including a reversing idler assembly configured to maintain tension on a belt of the dryer drum drive system during rotation of the drum in the first and second directions.

15. The laundry dryer of claim 14, wherein the reversing idler assembly includes at least two pulleys and a spring member, wherein the spring member includes two integrally formed arm portions configured to receive the at least two pulleys, said spring member biasing said pulleys toward each other.

16. A laundry dryer, comprising:

a housing;

a rotatable drum contained within the housing, wherein the rotatable drum is rotatable in a first direction and a second direction;

a drive system including a drive belt extending about the rotatable drum and a drive pulley, and a motor operably connected to said drive pulley to rotatably drive the drum in said first and second directions; and a reversing idler assembly pivotally mounted to a pivot point adjacent said drive pulley, including:

a pair of pulleys between which the drive belt extends to loop about the drive pulley;

a spring member including two integrally formed arm portions, the two arm portions being configured to receive each of the pair of pulleys for rotably mounting the same and for biasing the pulleys toward each other to thereby maintain tension on the drive belt as the drum rotates in the first and second directions.

17. The laundry dryer of claim 16, wherein the spring comprises a torsional spring adjoining said two arm portions.

18. The laundry dryer of claim 17, said reversing idler assembly further comprising a bushing about which said torsional spring extends, said bushing serving to pivotally mount the reversing idler assembly.

19. A reversing idler assembly configured for use in a laundry dryer including a belt-driven rotatable drum, comprising:

a pair of pulleys between which a drive belt may extend to loop about a drive pulley of a dryer;

a spring member including two integrally formed arm portions to which the pair of pulleys are mounted, said arm portions serving to bias the pulleys toward each other, to thereby place tension on a loop of the belt extending therethrough and around a drive pulley; and a pivotable mount for permitting said reversing idler assembly to be pivotably mounted within a laundry dryer adjacent said drive pulley, and to pivot upon a reversal of the drum rotation, to thereby maintain tension on the belt regardless of the rotation direction.

20. The reversing idler assembly of claim 19, wherein the spring member comprises a torsional spring integrally formed with said arm members.

21. The reversing idler assembly of claim 20, wherein said pivotable mount comprises a bushing about which said torsional spring extends.

* * * * *